US006622901B2

(12) United States Patent
Hamano et al.

(10) Patent No.: US 6,622,901 B2
(45) Date of Patent: Sep. 23, 2003

(54) STRUCTURE OF GUIDING NAIL IN NOSE SECTION OF NAILING MACHINE

(75) Inventors: Terufumi Hamano, Tokyo (JP); Kouji Kubo, Tokyo (JP)

(73) Assignee: Max Co., Ltd., Tokyo (JP)

( * ) Notice: Subject to any disclaimer, the term of this patent is extended or adjusted under 35 U.S.C. 154(b) by 121 days.

(21) Appl. No.: 09/758,138

(22) Filed: Jan. 12, 2001

(65) Prior Publication Data

US 2001/0022313 A1 Sep. 20, 2001

(30) Foreign Application Priority Data

Jan. 13, 2000 (JP) ..... 2000-005059

(51) Int. Cl.[7] ..... B25C 1/04
(52) U.S. Cl. ..... 227/119; 227/136
(58) Field of Search ..... 227/119, 120, 227/109, 136, 111

(56) References Cited

U.S. PATENT DOCUMENTS 3,708,095 A 1/1973 Briggs, Jr. ..... 227/126
4,463,888 A * 8/1984 Geist et al. ..... 227/119
4,549,682 A * 10/1985 Hebert ..... 227/119
4,832,245 A 5/1989 Terayama et al. ..... 227/130
5,263,842 A 11/1993 Fealy ..... 227/8
5,647,525 A * 7/1997 Ishizawa ..... 227/119
5,692,665 A * 12/1997 Lee ..... 227/109
5,738,266 A * 4/1998 Ogawa ..... 227/136

* cited by examiner

*Primary Examiner*—Scott A. Smith
(74) *Attorney, Agent, or Firm*—Morgan, Lewis & Bockius LLP

(57) ABSTRACT

An approach prevention wall for preventing a head portion of a lead nail from unnecessarily approaching is protruded on a front inner wall of the nose section of the nailing machine. The nose section accommodates the lead nail of connected nails, and the connected nails are connected with a connecting member. A lower end face of the approach prevention wall is inclined, and the inclined face of the lower end face of the approach prevention wall is formed at a position where the height of the inclined face is substantially the same as that of a position where the connecting member to connect the lead nail with the next nail is cut off at the time of driving the lead nail. Otherwise, the inclined face of the lower end face of the approach prevention wall is formed at a position where its height is higher than that.

1 Claim, 4 Drawing Sheets

STRUCTURE OF GUIDING NAIL IN NOSE SECTION OF NAILING MACHINE

BACKGROUND OF THE INVENTION

1. Field of the Invention

The present invention relates to a structure of guiding a nail, which has been driven by a driver in a nose section provided at a lower position of a nailing machine, so that the driven nail can not be tilted.

2. Description of the Related Art

In general, in a nailing machine using connected nails which are connected with each other in such a manner that portions of the head portions of the connected nails are superposed on each other, when a lead nail of the connected nails is fed to a nose section from a magazine, a head portion of the next nail also enters the nose section. Therefore, when the head portion of the lead nail is driven by a driver for driving, there is a possibility that the head portion of the next nail is driven by an end portion of the driver. As shown in FIG. 4(*a*), in order to prevent the head portion 105*a* of the lead nail 151 from unnecessarily proceeding, an approach prevention wall 107 having a guide groove 108 is formed on a front wall of the nose section 101. Due to the approach prevention wall 107, the head portion 105*a* of the next nail can wait for the next operation at the rear position and the head portion 105*a* of the next nail can not enter the nose section. Further, a cross section of the driver 103 is formed into a protruding shape. As shown in FIG. 4(*b*), a lower portion of the approach prevention wall 107 is inclined.

According to the above structure, the head portion 105*a* of the next nail does not enter the nose section 101 because the head portion 105*a* of the next nail is prevented by the approach prevention wall. Accordingly, there is no possibility that the head portions of two nails are simultaneously driven by the driver 103. When the lead nail is driven, the connecting member 106 to connect the lead nail 151 with the next nail 105*n* is cut off, so that only the lead nail is separated from the connected nails. Since no approach prevention wall exists in the periphery of the head portion of the separated lead nail 151, the inclined lead nail 151 becomes substantially perpendicular, and the nail 151 can be driven from the nose section 101 into material (not shown) into which the nail is going to be driven.

However, there is a possibility that the lead nail 151 in the nose section 101, which has been driven by the driver 103, is tilted with respect to the material into which the nail is going to be driven, and also there is a possibility that the lead nail 151, which has been driven by the driver 103, clogs in the nose section 101 and the nose section 101 is damaged.

The present inventors made investigation in good earnest. As a result of the investigation, they found the following causes. When the driver 103 drives the lead nail 151 of the connected nails as described above, as shown in FIG. 4(*b*), the front side of the nail with respect to the nail axis is driven. Accordingly, a front end portion of the nail tends to move to the rear by the action of rotation moment. Since the connected nails 105 are pushed forward by a pusher (not shown), after the connecting member 106 to connect the lead nail 151 with the next nail 105*n* is cut off and the lead nail is put into a free state, the lead nail 151 passes through on the inclined face 107*a* of the approach prevention wall 107. Therefore, while the lead nail 151 is passing through on the inclined face 107*a*, the lead nail 151 becomes unstable. For the above reasons, the head portion 105*a* of the nail tends to be directed to the front, and the forward end portion of the nail tends to be directed to the rear. Accordingly, after the nail has been driven, the lead nail is tilted to the front, which results in a defective driving of the nail.

SUMMARY OF THE INVENTION

The present invention has been accomplished to remove the causes of the above problems. It is an object of the present invention to provide a structure of guiding a nail in a nose section of a nailing machine capable of excellently guiding a nail which has been driven.

In order to solve the above problems, the present invention provides a structure of guiding a nail in a nose section of a nailing machine. The structure is characterized as follows:

An approach prevention wall for preventing a head portion of a lead nail from unnecessarily approaching is protruded on a front inner wall of the nose section of the nailing machine. The nose section accommodates the lead nail of the connected nails, which are connected with each other via a connecting member under the condition that the head portions of the connected nails are superposed on each other. The nose section guides the lead nail in the direction of driving. A lower end face of the approach prevention wall is inclined, wherein the inclined face of the lower end face of the approach prevention wall is formed at a position, the height of which is substantially the same as that of a position at which the connecting member to connect the lead nail with the next nail is cut off at the time of driving the lead nail, or the inclined face of the lower end face of the approach prevention wall is formed at a position, the height of which is higher than that.

DETAILED DESCRIPTION OF THE PREFERRED EMBODIMENTS

Figure 1:
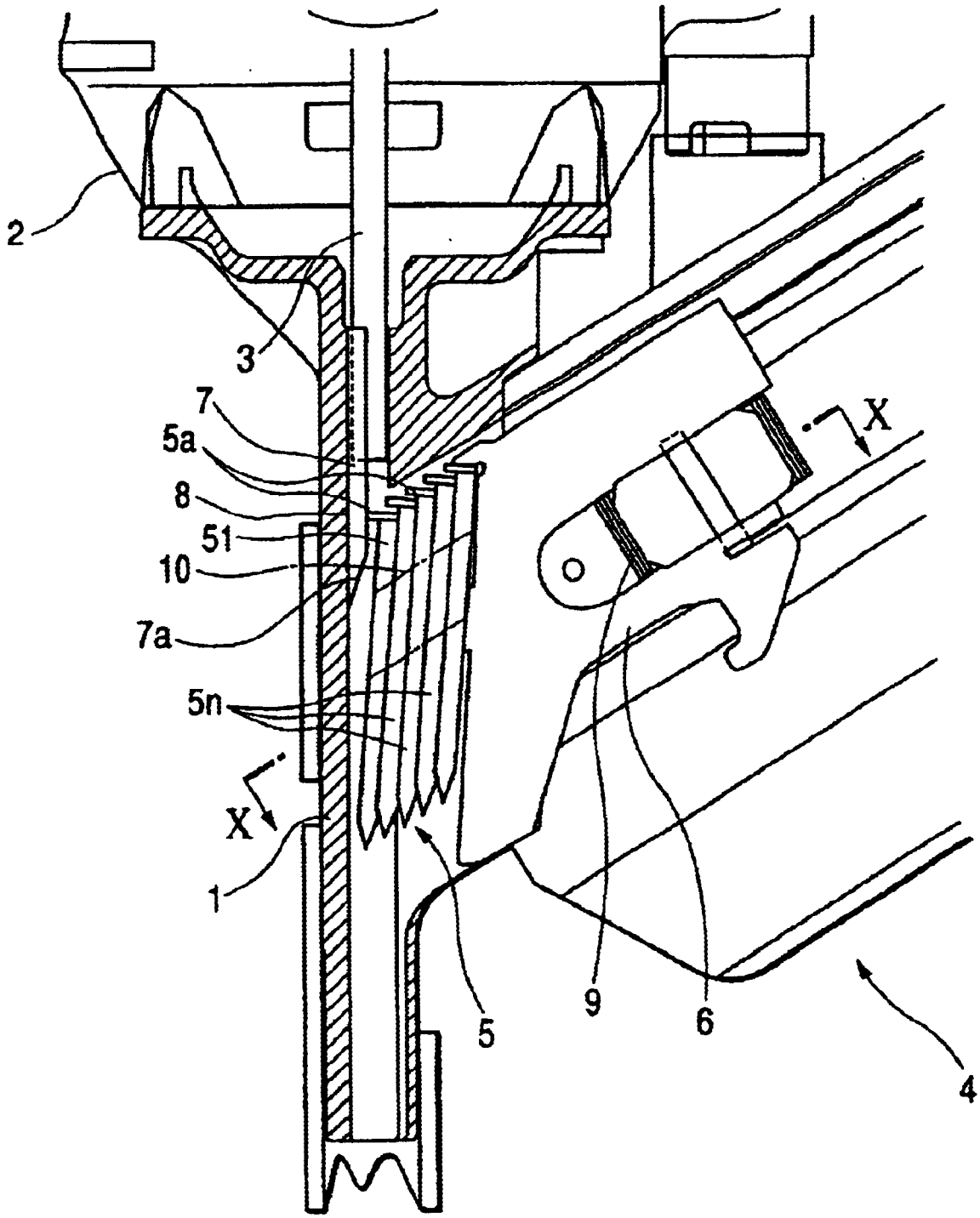
FIG. 1 is a longitudinal cross sectional view showing a periphery of a nose section of a nailing machine.

Reference numeral 1 shown in FIG. 1 is a nose section of a nailing machine. This nose section 1 is a cylindrical member extending to a lower portion of the nailing machine body 2. This nose section 1 guides a sliding motion of the driver 3 which is driven by a driving mechanism provided in the nailing machine body 2. At the same time, this nose section 1 opens to a forward end of the magazine 4 and accommodates the lead nail of connected nails 5 which are charged into the magazine 4. The lead nail 51 driven by the driver 3 can be guided by the nose section 1 in the direction of driving.

Figure 2:
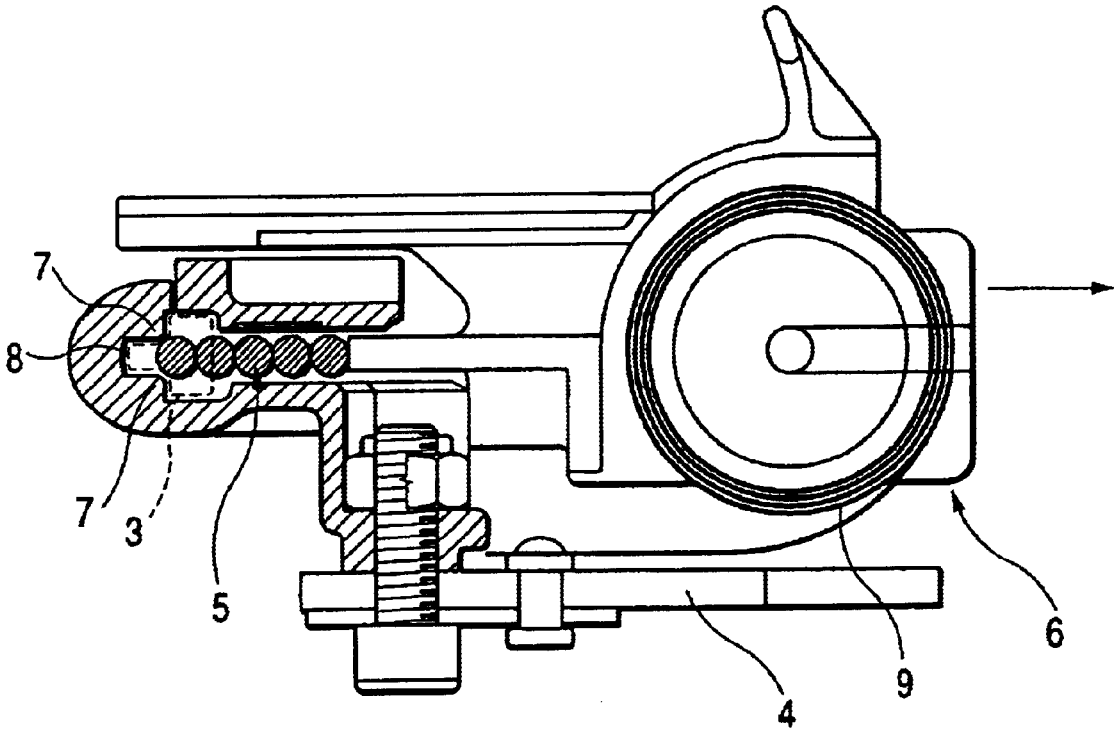
FIG. 2 is a cross-sectional view taken on line X—X in FIG. 1.

In the magazine 4, there is provided a pusher 6. As shown in FIG. 2, the pusher 6 pushes the connected nails 5, which are accommodated in the magazine 4, to the front by the constant output spring 9 at all times.

As shown in FIGS. 1 and 2, the connected nails 5 are composed in such a manner that eccentric nails 5*n*, the head portions of which are respectively formed into a D-shape, are connected with each other and formed into a stick-shape via the connecting member 10. The connected nails 5 are connected with each other while the head portions 5*a* of the nails 5*n* are being superposed on each other. The connecting member 10 is made of synthetic resin, wire or paper. The connected nails 5, which are charged into the magazine 4, are a little tilted with respect to the nose section 1. In this connection, the connected nails 5 are not limited to the above eccentric nails, but it is possible to use nails, the head portions of which are circular and superposed on each other, connected with each other via the connecting member.

Next, as shown in FIG. 2, the approach prevention wall 7 is protruded from the front inner wall of the nose section 1. The approach prevention wall 7 is provided for preventing the head portion 5*a* of the lead nail 51 from unnecessarily proceeding. At the center of the back face of the approach prevention wall 7, there is provided a guide groove 8 which is formed along the center of the nose section 1. The width of the guide groove 8 is smaller than the diameters of the head portions 5*a* of the connected nails 5. The cross section of the driver 3 is formed into a protruding shape corresponding to the cross section of the guide groove 8, and the protruding section on the front face is engaged with and guided in the guide groove 8. At the lower end of this approach prevention wall 7, there is provided an inclined face 7*a*. As shown in FIG. 1, the inclined face 7*a* is located in a position adjacent to the head portion of the lead nail 51. Specifically, the inclined face 7*a* is located at a position where its height is substantially the same as that of a position where the connecting member 10 to connect the lead nail 51 with the next nail 5*n* is cut off when the lead nail 51 is driven. Otherwise, the inclined face 7*a* may be located at a position where its height is higher than that.

According to the above structure, the connected nails 5 accommodated in the magazine 4 are pushed by the pusher 6, and the lead nail 51 is fed into the nose section 1. However, the approach prevention wall 7 is formed in the nose section 1. Therefore, the head portion 5*a* of the lead nail 51 is blocked by the approach prevention wall 7 and can not proceed any more. Therefore, the head portion 5*a* of the next nail 5*n* next to the lead nail 51 can not enter the nose section 1, that is, the head portion 5*a* of the next nail 5*n* is made to wait at the rear of the lead nail 51.

Figure 3:
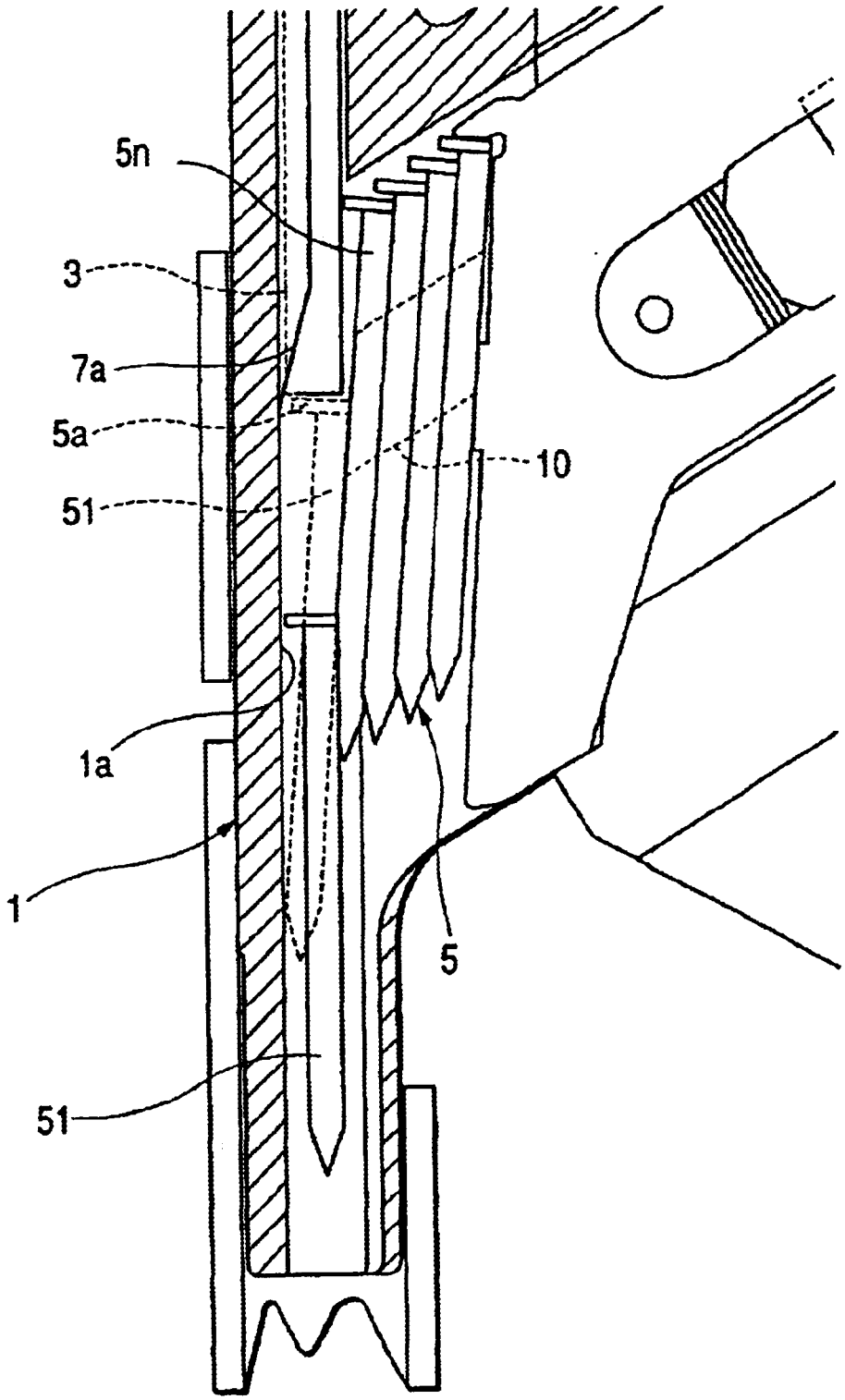
FIG. 3 is a view for explaining driving of a nail.
Figure 4A:
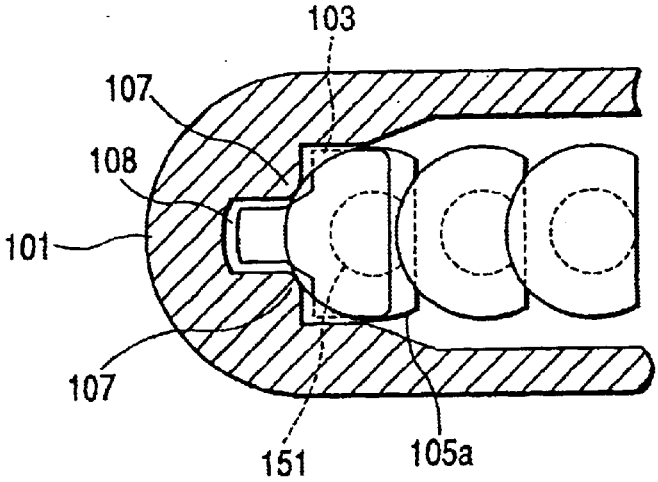
FIG. 4(a) RELATED ART
FIGS. 4(*a*) and 4(*b*) are respectively a lateral cross-sectional view and a longitudinal cross-sectional view of a nose section of a nailing machine.
Figure 4B:
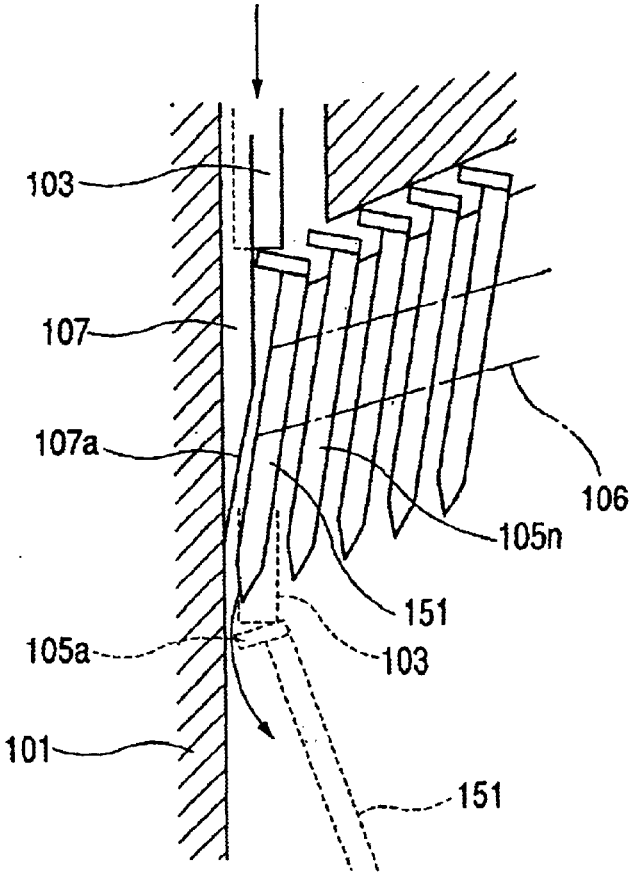
FIG. 4(b) RELATED ART

When the driving mechanism in the nailing machine body 2 is operated and the driver 3 is driven downward under the above condition, the head portion 5*a* of the lead nail 51 is driven. In this case, the head portion 5*a* of the next nail 5*n* is not simultaneously driven. As shown in FIG. 3, the lead nail 51, which has been driven, is moved downward. However, since the head portion 5*a* proceeds along the inclined face 7*a* of the approach prevention wall 7, the head portion 5*a* moves to the front. Then the connecting member 10, which connects the lead nail 51 with the next nail 5*n*, is cut off. Therefore, the lead nail 51 can be set free.

In this connection, while the lead nail 51 is connected with the next nail 5*n* by the connecting member 10, the head portion 5*a* of the lead nail 51 reaches the front inner wall face 1*a*, the profile of which is arcuate, of the nose section 1, so that the lead nail 51 is put into a stable condition. The connecting member 10 for stably holding the lead nail 51 is cut off after that. As described above, after the lead nail 51 has been put into a stable condition, it is driven. Therefore, while the lead nail 51 is not being inclined, it can be perpendicularly driven into material into which the nail is going to be driven. Accordingly, it is possible to ensure an excellent driving condition.

What is claimed is:

1. A nail guiding structure in a nose section of a nailing machine, in combination with connected nails, comprising:

an approach prevention wall for preventing a head portion of a lead nail of the connected nails from unnecessarily approaching, said approaching prevention wall being protruded on a front inner wall of the nose section of the nailing machine and including a lower end face having an inclined face; and a front inner wall face of the nose section, wherein the nose section accommodates the lead nail of the connected nails, which are connected with each other with a connecting member under the condition that the head portions of the connected nails are superposed on each other, and the nose section guides the lead nail in the direction of driving, and the inclined face of the lower end face of said approach prevention wall is formed at a position, the height of which is higher than that of a position at which the connecting member to connect the lead nail with the next nail is cut off at the time of driving the lead nail, and the front inner wall face comes in contact with the head portion of the lead nail while the lead nail is connected with the next nail by the connecting member.

* * * * *